US009518738B2

(12) United States Patent
Gerendas

(10) Patent No.: US 9,518,738 B2
(45) Date of Patent: Dec. 13, 2016

(54) IMPINGEMENT-EFFUSION COOLED TILE OF A GAS-TURBINE COMBUSTION CHAMBER WITH ELONGATED EFFUSION HOLES

(71) Applicant: Rolls-Royce Deutschland Ltd & Co KG, Blankenfelde-Mahlow (DE)

(72) Inventor: Miklos Gerendas, Am Mellensee (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 388 days.

(21) Appl. No.: 14/180,028

(22) Filed: Feb. 13, 2014

(65) Prior Publication Data

US 2014/0238030 A1 Aug. 28, 2014

(30) Foreign Application Priority Data

Feb. 26, 2013 (DE) ..... 10 2013 003 444

(51) Int. Cl.
*F23R 3/00* (2006.01)
*F23R 3/06* (2006.01)

(52) U.S. Cl.
CPC ..... *F23R 3/002* (2013.01); *F23R 3/06* (2013.01); *F23R 2900/03041* (2013.01); *F23R 2900/03044* (2013.01); *F23R 2900/03045* (2013.01)

(58) Field of Classification Search
CPC ... F23R 3/002; F23R 3/06; F23R 2900/03045; F23R 2900/03044; F23R 2900/03041
See application file for complete search history.

(56) References Cited

U.S. PATENT DOCUMENTS

| | | | | |
|---|---|---|---|---|
| 5,000,005 | A | 3/1991 | Kwan et al. | |
| 6,408,620 | B2 | 6/2002 | Boegner et al. | |
| 6,408,628 | B1 | 6/2002 | Pidcock et al. | |
| 6,708,499 | B2 | 3/2004 | Pidcock et al. | |
| 7,549,290 | B2 | 6/2009 | Holt et al. | |
| 8,099,961 | B2 * | 1/2012 | Gerendas | F23R 3/002 60/752 |

(Continued)

FOREIGN PATENT DOCUMENTS

| | | |
|---|---|---|
| DE | 86 18 859 | 1/1988 |
| DE | 10 2009 007 164 | 8/2010 |

(Continued)

OTHER PUBLICATIONS

German Search Report dated Oct. 7, 2013 from counterpart app No. 10 2013 003 444.2.

(Continued)

*Primary Examiner* — John C Hong
(74) *Attorney, Agent, or Firm* — Shuttleworth & Ingersoll, PLC; Timothy Klima

(57) ABSTRACT

The present invention relates to a gas-turbine combustion chamber having a combustion chamber wall including a tile carrier, on which wall tiles are mounted at a distance to form an impingement cooling gap, where the tile carrier has impingement cooling holes and the tile is provided with effusion holes, where the tile has on its side facing the tile carrier a surface structure which raises from the surface of the tile and extends in the direction of the tile carrier.

12 Claims, 7 Drawing Sheets

(56) References Cited

U.S. PATENT DOCUMENTS

Figure 1:
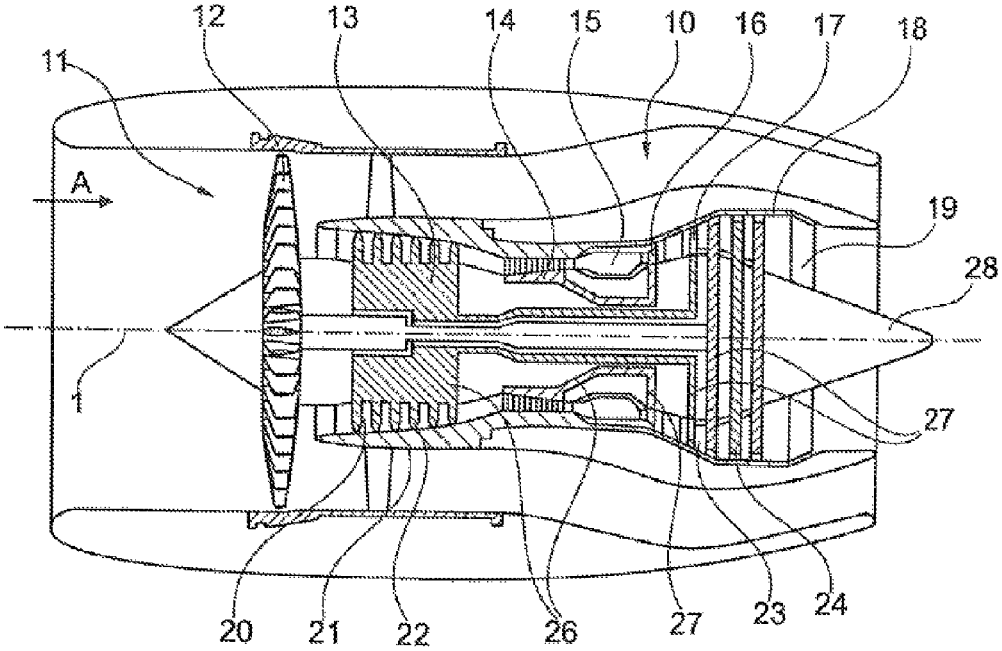

| | | | | |
|---|---|---|---|---|
| 8,516,822 | B2 | 8/2013 | Chen et al. | |
| 2002/0124572 | A1 | 9/2002 | Pidcock et al. | |
| 2010/0192588 | A1 | 8/2010 | Gerendas | |
| 2011/0214429 | A1* | 9/2011 | Chen | F23R 3/005 60/755 |

FOREIGN PATENT DOCUMENTS

| | | | |
|---|---|---|---|
| DE | 102011000879 | A1 | 9/2011 |
| EP | 1635119 | A2 | 3/2006 |
| EP | 1983265 | | 10/2008 |
| EP | 2241813 | A2 | 10/2010 |
| GB | 2087065 | | 5/1982 |
| GB | 2360086 | | 9/2001 |
| JP | S5872822 | | 4/1983 |
| JP | H1162504 | | 3/1999 |
| WO | 9216798 | | 10/1992 |
| WO | 9525932 | | 9/1995 |

OTHER PUBLICATIONS

European Search Report dated Aug. 31, 2015 for related European Application No. 14156300.7.

* cited by examiner

State of the art

State of the art

State of the art

State of the art

IMPINGEMENT-EFFUSION COOLED TILE OF A GAS-TURBINE COMBUSTION CHAMBER WITH ELONGATED EFFUSION HOLES

This application claims priority to German Patent Application DE102013003444.2 filed Feb. 26, 2013, the entirety of which is incorporated by reference herein.

This invention relates t gas-turbine combustion chamber in accordance with the generic part of claim 1.

In particular, the invention relates to a gas-turbine combustion chamber having a combustion chamber wall. A plurality of tiles are mounted on the combustion chamber wall or on a tile carrier provided thereon. For cooling of the tiles and of the combustion chamber wall, the tile carrier is provided with impingement cooling holes through which is passed cooling air that impacts the wall or surface of the tile arranged at a distance from the tile carrier. The air is then passed through effusion holes of the tile in order to achieve cooling of the surface of the tile.

The state of the art shows a variety of cooling concepts for cooling the tiles of the combustion chamber. In detail, the state of the art shows the following solutions as examples:

Specification WO 92/16798 A1 describes the design of a gas-turbine combustion chamber with metallic tiles attached by stud bolts which, by combination of impingement and effusion cooling, provides an effective form of cooling, enabling the consumption of cooling air to be reduced. However, the pressure loss, which exists over the wall, is distributed to two throttling points, namely the tile carrier and the tile itself. In order to avoid peripheral leakage, the major part of the pressure loss is mostly produced via the tile carrier, reducing the tendency of the cooling air to flow past the effusion tile.

Specification GB 2 087 065 A discloses an impingement cooling configuration with a pinned or ribbed tile, with each individual impingement cooling jet being protected against the transverse flow by means of an upstream pin or rib provided on the tile. Furthermore, the pins or ribs increase the surface area available for heat transfer.

Specification GB 2 360 086 A shows an impingement cooling configuration with hexagonal ribs and prisms being partly additionally arranged centrally within the hexagonal ribs to improve heat transfer.

Specification WO 95/25932 A1 discloses a combustion chamber wall where ribs are provided on the cooling air side, in which the effusion holes are provided at a shallow angle.

Specification U.S. Pat. No. 6,408,628 A describes a combustion chamber wall equipped with pinned tiles, in which effusion holes are additionally provided at a small angle to the surface.

Specification U.S. Pat. No. 5,000,005 A shows a heat shield for a combustion chamber having cooling, holes provided at a shallow angle to the surface and widening in the flow direction.

Specification WO 92/16798 A1 uses only a plane surface as target for impingement cooling. A provision of ribs would, except for simply increasing the surface area, have little use as the ribs, which are shown, for example, in Specification GB 2 360 086 A, require overflow to be effective. However, due to the coincidence of the impingement cooling air supply and the air discharge via the effusion holes, no significant velocity is obtained in the overflow of the ribs. The pressure difference over the tile is partly reduced by the burner swirl to such an extent that the effusion holes are no longer effectively passed by the flow or, even worse, hot-gas ingress into the impingement cooling chamber of the tile may occur.

Film cooling is the most effective form of reducing the wall temperature since the insulating cooling film protects the component against the transfer of heat from the hot gas, instead of subsequently removing introduced heat by other methods. Specifications GB 2 087 065 A and GB 360 086 A provide no technical teaching on the renewal of the cooling film on the hot gas side within the extension of the tile. The tile must in each case be short enough in the direction of flow that the cooling film produced by the upstream the bears over of the entire length of the tile. This invariably requires a plurality of tiles to be provided along the combustion chamber wall and prohibits the use of a single tile to cover this distance.

In Specification GB 2 087 065 A, the air passes in the form of a laminar flow along a continuous, straight duct, providing, despite the complexity involved, for quick growth of the boundary layer and rapid reduction of heat transfer.

Specification GB 2 360 086 A does not provide a technical teaching as regards the discharge of the air consumed. Therefore, also this arrangement is only suitable for small tiles. With larger tiles, the transverse flow would become too strong, and the deflection of the impingement cooling jet would impede the impingement cooling effect.

Specification WO 95/25932 A1 describes a single-walled combustion chamber design in which no impingement cooling takes place on the cooling air side, but only convection cooling.

Specification U.S. Pat. No. 6,408,628 A shows a combustion chamber wall where the pressure difference over the tile cannot be fully optimized either for convective cooling, since the latter prefers a large pressure difference, or for effusion cooling, since this prefers a small pressure difference for improving film cooling.

Specification U.S. Pat. No. 5,000,005 A relates to a heat shield for a combustion chamber provided with cooling openings widening in the flow direction, without referring to the geometrical relationship of impingement cooling holes and diffusive effusion holes.

The present invention, in a broad aspect, provides for a gas-turbine combustion chamber and a combustion chamber tile, which enable high cooling efficiency while being simply designed and easily and cost-effectively producible.

It is a particular object to provide a solution to the above problems by a combination of features described herein. Further advantageous embodiments will become apparent from the present description.

In accordance with the invention, therefore, a design is provided in which tiles are mounted on a tile carrier at a distance. The tiles can, for example, be fastened by means of threaded bolts or similar. The tile carrier has impingement cooling holes through which the cooling air is passed in order to impact that side of the tile facing away from the combustion chamber and facing the tile carrier, thereby cooling the tile. The tiles have effusion holes through which the air can exit the intermediate space between the tile carrier and the tile (impingement cooling gap). The air exiting through the effusion holes is used for film cooling of the tile. To achieve an improved heat transfer in the area of the tile and to design the effusion holes with a high efficiency, it is provided that the inlet openings of the effusion holes are designed on raised areas of a surface structure of the tile. The tile thus has a surface structure which can be rib-like. It is however also possible to design the surface structure in the form of singular raised areas or in similar manner. What is important in the scope of the invention is that the inlet openings of the effusion holes are at a distance from the surface of the tile and are hence arranged closer to the surface of the tile carrier. This leads to more favourable flow conditions and to a better heat transfer.

In a particularly favourable embodiment of the invention, it is provided that the distance from the inlet opening to the surface of the tile carrier is 0.5 to 1.5 of the diameter of the inlet opening. This leads to particularly efficient air guidance and inflow into the inlet opening of the respective effusion hole.

The centric axis of the inlet openings and hence the centric axis of the at least first area of the effusion hole is arranged preferably substantially perpendicular to the surface of the tile carrier and/ or is oriented preferably parallel to the centric axis of the impingement cooling hole. This results in an improved flow guidance.

A further measure to ensure inflow into the inlet openings even during operation with a thermally caused distortion is to provide, adjacently to the inlet opening, at least one spacer. The latter prevents in the event of thermal distortion that the effusion hole can be closed off by the tile carrier. This spacer can also partially enclose the inlet opening, and it can also be designed such that it creates a swirl of the air flowing into the inlet opening.

The effusion hole can be designed straight or curved, or partially straight and partially curved. It can be provided with a constant or with a widening cross-section.

It is furthermore possible to design the surface structure in the form of cells with triangular, rectangular or polygonal shape. The surface structure can also be designed in the form of a circular recessed area: as a result, the impingement cooling jets of the air jets exiting the impingement cooling holes can be guided into the middle of these cells or recessed areas in order to improve the flow conditions. In this connection it is also possible for a prism or a similar device to be provided inside these cells to distribute the air evenly.

Figure 2:
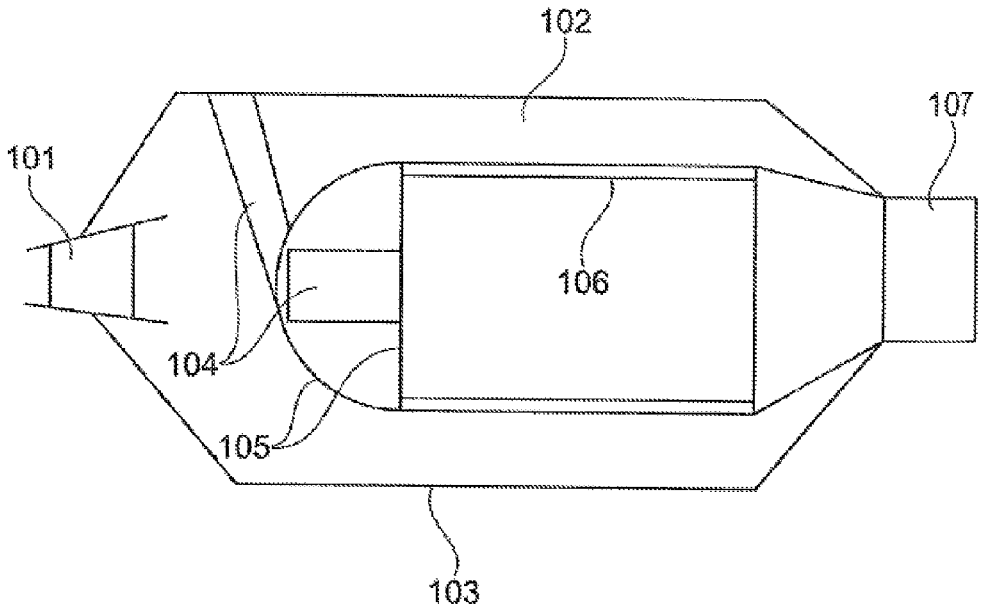
Figure 3:
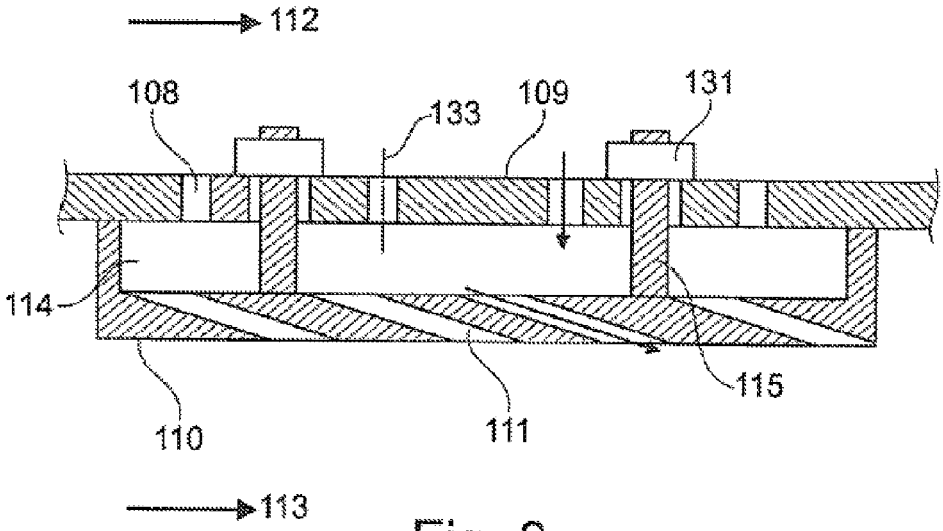
Figure 4:
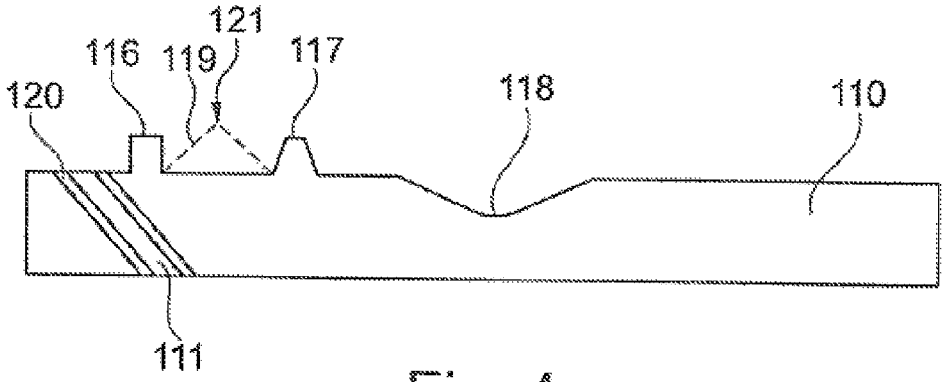
Figure 5:
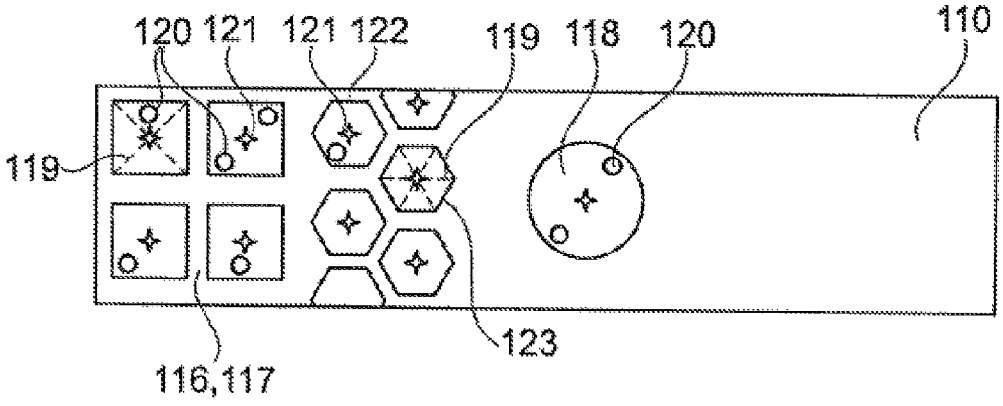
Figure 6:
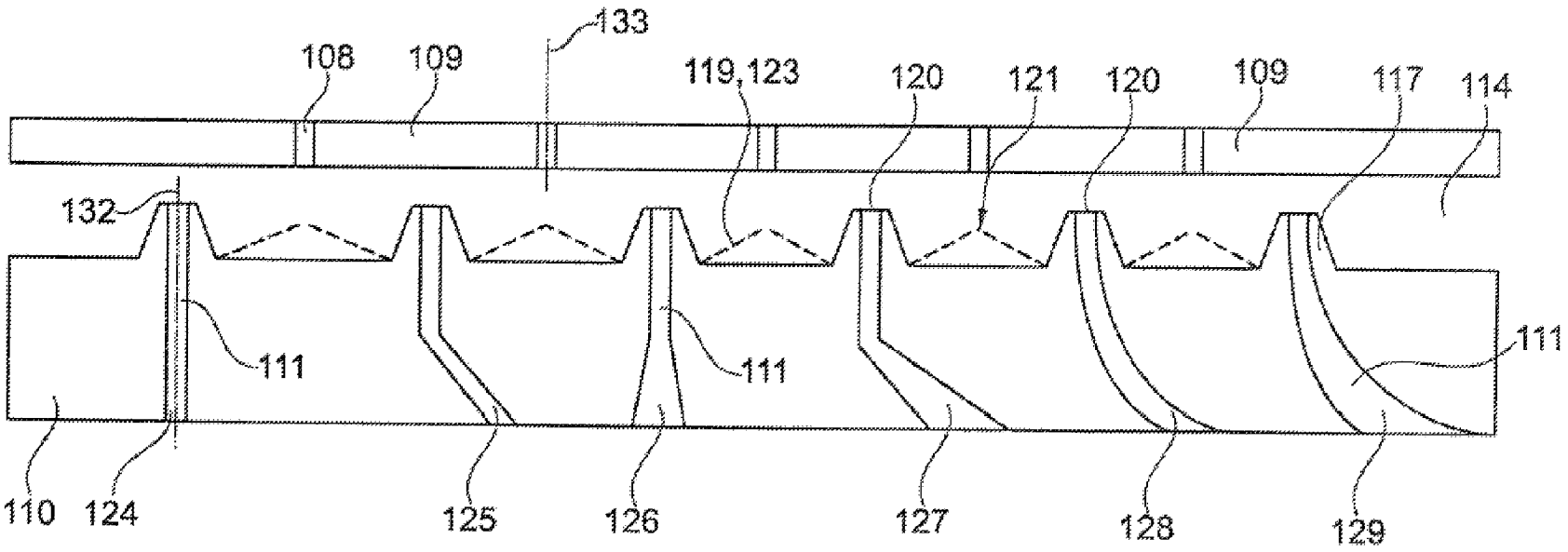
Figure 7:
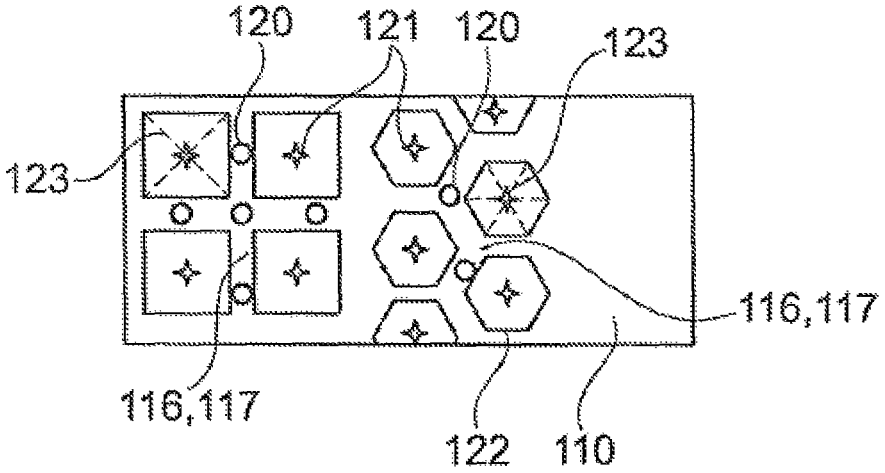
Figure 8:
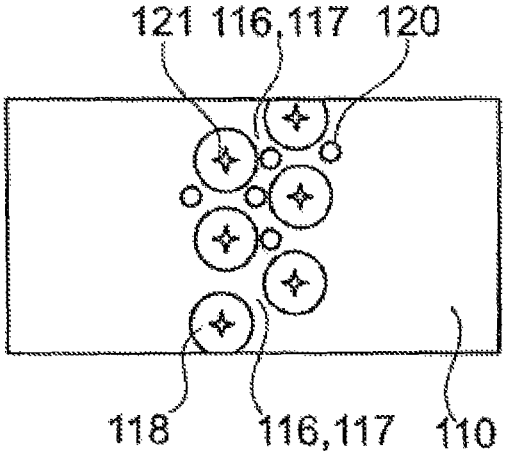
Figure 9:
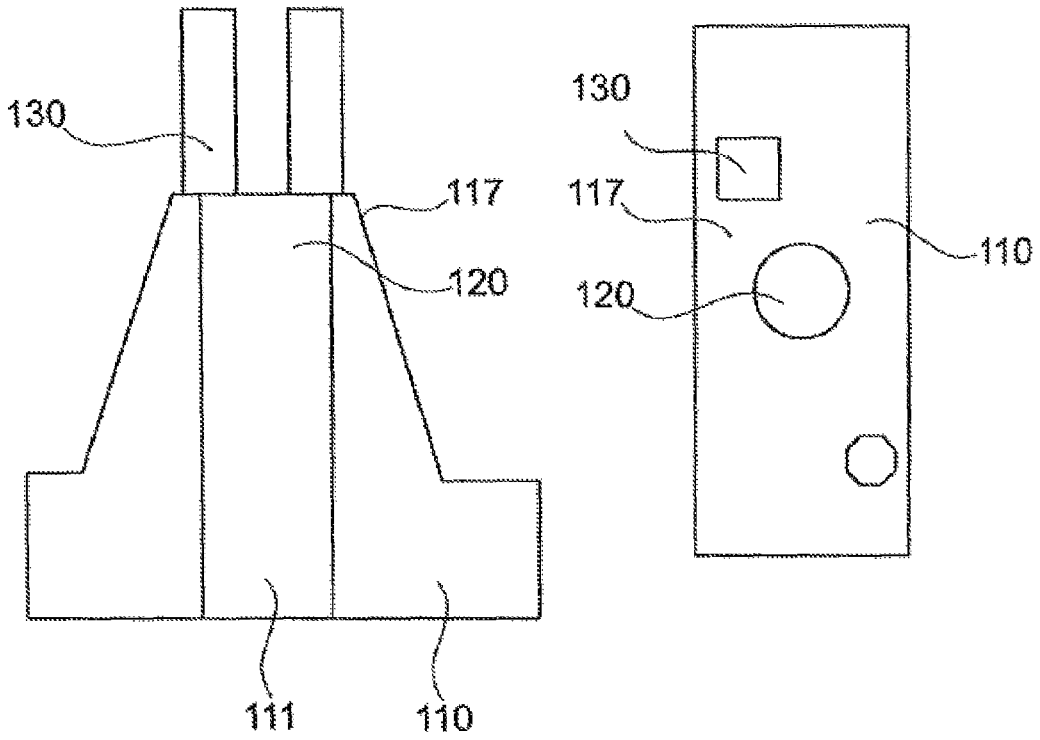
Figure 10:
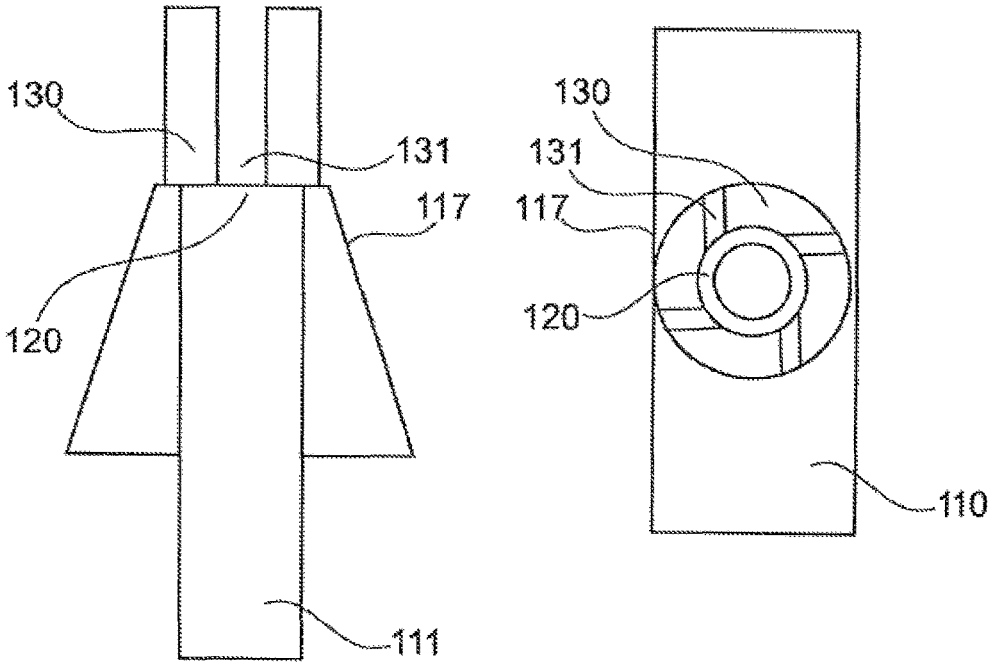

The present invention is described in the following in light of the accompanying drawing showing exemplary embodiments. In the drawing, FIG. 1 shows a schematic representation of a gas-turbine engine in accordance with the present invention, FIG. 2 shows a schematic sectional view of a gas-turbine combustion chamber in accordance with the state of the art, FIG. 3 shows a simplified sectional side view of a the carrier/tile structure in accordance with the state of the art, FIG. 4 shows a simplified sectional side view of a tile in accordance with the state of the art, FIG. 5 shows a top view onto a tile in accordance with the state of the art, FIG. 6 shows a side view, by analogy with FIG. 3, of an embodiment in accordance with the present invention, FIG. 7 shop a top view onto an exemplary embodiment of the present invention, FIG. 8 shows a further top view onto an exemplary embodiment of a tile, by analogy with FIG. 7, FIG. 9 shows detail side view of a further exemplary embodiment of a tile, and FIG. 10 shows a schematic representation of a further exemplary embodiment by analogy with FIG. 9.

The gas-turbine engine 10 in accordance with FIG. 1 is a generally represented example of a turbomachine where the invention can be used. The engine 10 is of conventional design and includes in the flow direction, one behind the other, an air inlet 11, a fan 12 rotating inside a casing, an intermediate-pressure compressor 13, a high-pressure compressor 14, a combustion chamber 15, a high-pressure turbine 16, an intermediate-pressure turbine 17 and a low-pressure turbine 18 as well as an exhaust nozzle 19, all of which being arranged about a center engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17. 18 have similar stages, including an arrangement of fixed stator vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

FIG. 2 shows, in schematic representation, a cross-section of a gas-turbine combustion chamber according to the state of the art. Schematically shown here are compressor outlet vanes 101, a combustion chamber outer casing 102 and a combustion chamber inner casing 103. Reference numeral 104 designates a burner with arm and head, reference numeral 105 designates a combustion chamber head followed by a combustion chamber wall 106 by which the flow is ducted to the turbine inlet vanes 107.

FIG. 3 shows the structure of a design known from the state of the art. It, shows in a sectional view a tile carrier 109, which can be identical to the combustion chamber wall 106 or be designed as a separate component. The tile carrier 109 is provided with a plurality of impingement cooling holes 108 whose axes 133 are arranged perpendicular to the center plane or to the surfaces of the plate-like tile carrier 109. Cooling air flows through the impingement cooling holes 108 into an impingement cooling gap 114, the latter being formed by arranging a tile 110 at a distance. The tile 110 is fastened by means of threaded bolts 115 and nuts 131. The tile 110 furthermore has effusion holes 111 through which the cooling air flows out for cooling the surface by means of a cooling film. The reference numeral 112 designates the cooling airflow, while the reference numeral 113 shows the hot gas flow.

FIG. 4 shows a further representation of a tile according to the state of the art. The tile here has on its side facing the tile carrier a surface structure 116 and 117 which can be designed in the form of ribs or singular raised areas. In addition, prisms 119 are provided to distribute the exiting cooling air. The surface structure can also be designed with recessed areas 118.

FIG. 5 shows a schematic top view by analogy with FIG. 4. It can be seen here that the effusion holes 111 have an inlet opening 120 through which the cooling air flows in. It can be seen from FIG. 5 that the inlet openings in the state of the art are arranged on the flanks of the prism 119 or in the zone of the recessed area 118.

FIG. 6 shows an exemplary embodiment of the invention. The tile carrier 109 has, as in the state of the art, several impingement cooling holes 108. These are arranged such that they preferably impact the tips 121 of the prisms 119. In accordance with the invention, the inlet openings 120 of the effusion holes 111 are provided on the raised areas of the surface structure 116, 117. These raised areas can be designed, as known from the state of the art, in the form of ribs or singular raised areas.

FIG. 6 furthermore shows that the effusion holes 111 can be designed straight or angled. The cross-section can remain constant or can widen. It is also possible to design the effusion holes 111 curved. The right-hand half of FIG. 6 shows an enlarged and curved cross-section 129, next to it a constant and curved cross-section 128. The cross-section 127 is designed straight and widening section by section. By contrast, the cross-section 126 is designed straight and widens in the second partial area. The cross-section 125 is designed angled and has a constant cross-section each. The cross-section 124 is designed straight and has a constant cross-section. The reference numeral 132 shows the centric axis of the inlet opening 120 or of the adjacent area of the effusion hole 111.

FIGS. 7 and 8 each show top views onto design variants. They show that in each case the inlet openings 120 are arranged on the raised areas of the surface structures 116, 117 or adjacent to recessed areas 118. The reference numeral 122 shows a hexagonal structure or cell, while the reference numeral 123 shows a prism.

FIGS. 9 and 10 each show enlarged side views of further exemplary embodiments, where spacers 130 are provided adjoining the inlet opening 120. These can, as shown in particular in FIG. 10, be designed to create a swirl.

The following re-summarizes the most important aspects of the present invention, making reference to the exemplary embodiments but not restricting them:

Impingement-effusion cooled tiles 110 are equipped with a surface structure 116, 117, for example by hexagonal ribs or by other polygonal shapes or pins, with the consumed air being discharged through effusion holes 111 from the impingement cooling gap 114, where:

a) the inlet openings 120 of the effusion holes 111 are located on the raised part of the surface structure 116, 117 arranged close to the tile carrier 109, hence the inlet openings are positioned to 0.5 to 1.5 times the diameter of the inlet opening 120 of the effusion hole 111 from the tile carrier 109, and b) the axis of the inlet opening 120 of the effusion holes 111 is aligned substantially parallel to the direction of the impingement cooling holes 109 and hence substantially perpendicular to the tile carrier 109 through which the impingement cooling holes 109 are drilled, and c) additionally, spacers 130 are formed around the inlet opening 120 such that the inlet opening cannot be blocked even after deformation resulting from operation.

The effusion holes 111 can have a constant cross-section 124, 125. 128 or a cross-section 126, 127, 129 widening in the flow direction. The effusion holes can have a continuously straight axis 124. 126, a section-by-section straight axis 125, 127 or an arch-shaped axis 128, 129. The expanded exit cross-section is preferably provided at an angle of less than 90° relative to the surface.

The spacers 130 are normally not in contact with the tile carrier due to tolerances, as they could, depending on the tolerance situation, be longer'than the tile rim is high, and thus could cause an increase in rim leakage.

The spacers 130 can additionally be designed such that they impart a swirl to the air flowing into the effusion hole 111 in front of the inlet opening 120.

By imparting a swirl to the air before it enters the effusion hole 111, the heat transfer inside the effusion hole 111 is increased.

The surface structure 116, 117 can be designed in the form of hexagonal ribs, which can be filled with a prism 119, 123 in such a way that the tip 121 of the prism 119, 123 is at the level of the ribs, or above or below it.

The surface structure 116, 117 can be formed from triangular, rectangular or other polygonal cells 122. The surface structure can also consist of circular recessed areas 118. The impingement cooling jets therefore impact the tile 110 substantially in the center of the polygonal cell or at the lowest point of the circular recessed area.

On the side facing the hot gas, the tile 110 can have a heat-insulating layer made of ceramic material.

The impingement cooling holes 108 can vary in diameter in the axial and/ or circumferential directions, as can the effusion holes 111 and the dimensions of the surface structure 116, 117.

The impingement cooling holes 108 are aligned substantially perpendicular to the impingement cooling surface and to the main flow directions of cooling air 112 and hot gas 113.

By placing the inlet openings 120 of the effusion holes 111 on the raised parts of the surface structure 116, 117, the length of the effusion holes 111 is increased and hence its overall surface and also the transferred heat quantity.

If the total of the effusion hole surfaces is selected large relative to the total of the impingement cooling inlet surfaces, a simple perpendicular hole is sufficient.

If the total of the surfaces of the inlet openings 120 of the effusion holes 111 is lower, it is possible by curving the axis 132 or by widening the flow duct (or both) to reduce the wall-normal speed of the outflowing air and to achieve a good film cooling effect despite the small inlet surface 120 of the effusion hole 111.

The invention is not restricted to the described combination between tile carrier and tile, but instead also relates to a combustion chamber tile as such.

LIST OF REFERENCE NUMERALS

1 Engine axis
10 Gas-turbine engine/core engine
11 Air inlet
12 Fan
13 Intermediate-pressure compressor (compressor)
14 High-pressure compressor
15 Combustion chamber
16 High-pressure turbine
17 Intermediate-pressure turbine
18 Low-pressure turbine
19 Exhaust nozzle
20 Stator vanes
21 Engine casing
22 Compressor rotor blades
23 Stator vanes
24 Turbine blades
26 Compressor drum or disk
27 Turbine rotor hub
28 Exhaust cone
101 Compressor outlet vane
102 Combustion chamber outer casing
103 Combustion chamber inner casing
104 Burner with arm and head
105 Combustion chamber head
106 Combustion chamber wall
107 Turbine inlet vane
108 Impingement cooling hole
109 Tile carrier

110 Tile
111 Effusion hole
112 Cooling airflow
113 Hot gas flow
114 Impingement cooling gap
115 Threaded bolt
116 Surface structure
117 Surface structure
118 Recessed area
119 Prism
120 Inlet opening
121 Tip of prism
122 Hexagonal structure/cell
123 Prism
124 Straight axis, constant cross-section
125 Section by section straight axis, constant cross-section
126 Widening cross-section, straight axis
127 Section by section straight axis, widening cross-section
128 Constant cross-section
129 Widening cross-section
130 Spacer
131 Nut
132 Axis of inlet opening 120
133 Axis of impingement cooling hole 108

What is claimed is:

1. A gas turbine combustion chamber, comprising:

a combustion chamber wall including a tile carrier, a plurality of wall tiles mounted on the tile carrier spaced apart from the tile carrier to form an impingement cooling gap between the tile carrier and the plurality of wall tiles, wherein the tile carrier includes a plurality of impingement cooling holes and each wall tile includes a plurality of effusion holes with inlet openings, wherein each wall tile includes, on a side facing the tile carrier, a surface structure which includes raised portions rising from a surface of the wall tile and extending in a direction toward the tile carrier;

wherein the inlet openings of the effusion holes are located on the raised portions of the surface structure;

wherein the centric axes of the inlet openings are arranged substantially perpendicular to a surface of the tile carrier;

wherein the centric axes of the inlet openings are arranged substantially parallel to centric axes of the impingement cooling holes;

wherein the raised portions are formed as ribs;

wherein the impingement cooling holes are arranged to direct impingement air jets into a space between the ribs and spaced apart from the inlet openings.

2. The gas turbine combustion chamber in accordance with claim 1, wherein the inlet openings of the effusion holes are spaced a distance from the surface of the tile carrier which is 0.5 to 1.5 times a diameter of the inlet openings.

3. The gas turbine combustion chamber in accordance with claim 1, and further comprising a spacer arranged around at least one of the inlet openings that at least partially encloses the at least one of the inlet openings.

4. The gas turbine combustion chamber in accordance with claim 3, wherein the spacer is shaped to impart a swirl to air flowing into the at least one of the inlet openings.

5. The gas turbine combustion chamber in accordance with claim 1, and further comprising a spacer arranged adjacent to at least one of the inlet openings.

6. The gas turbine combustion chamber in accordance with claim 1, wherein the effusion holes are straight.

7. The gas turbine combustion chamber in accordance with claim 1, wherein the effusion holes have a constant.

8. The gas turbine combustion chamber in accordance with claim 1, wherein the raised portions include polygonal cells, with a prism positioned in each of the polygonal cells.

9. The gas turbine combustion chamber in accordance with claim 1, wherein the effusion holes have a widening diameter.

10. The gas turbine combustion chamber in accordance with claim 1, wherein the effusion holes are curved.

11. The gas turbine combustion chamber in accordance with claim 1, wherein the effusion holes are partially straight.

12. The gas turbine combustion chamber in accordance with claim 1, wherein the effusion holes are partially curved.

* * * * *